US008816655B2

(12) United States Patent
Zhu

(10) Patent No.: US 8,816,655 B2
(45) Date of Patent: Aug. 26, 2014

(54) VOLTAGE REGULATOR HAVING SOFT STARTING FUNCTION AND METHOD OF CONTROLLING THE SAME

(75) Inventor: Haigang Zhu, Suzhou (CN)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 275 days.

(21) Appl. No.: 13/280,496

(22) Filed: Oct. 25, 2011

(65) Prior Publication Data

US 2012/0098508 A1 Apr. 26, 2012

(30) Foreign Application Priority Data

Oct. 25, 2010 (CN) ..... 2010 1 0526419
Sep. 23, 2011 (KR) ..... 10-2011-0096502

(51) Int. Cl.
*G05F 1/59* (2006.01)

(52) U.S. Cl.
USPC ..... 323/269; 323/901

(58) Field of Classification Search
USPC ..... 323/269, 273–281, 901
See application file for complete search history.

(56) References Cited

U.S. PATENT DOCUMENTS

2007/0046271 A1* 3/2007 Zolfaghari ..... 323/274
2007/0127276 A1 6/2007 Yoshimatsu et al.
2008/0191670 A1* 8/2008 Oddoart et al. ..... 323/273
2009/0273327 A1 11/2009 Ito et al.

FOREIGN PATENT DOCUMENTS

JP 2005-202985 7/2005

* cited by examiner

*Primary Examiner* — Harry Behm
*Assistant Examiner* — Matthew Grubb
(74) *Attorney, Agent, or Firm* — F. Chau & Associates, LLC

(57) ABSTRACT

A voltage regulator apparatus includes a first power transistor and a second power transistor connected in parallel to each other between a first power source and a second power source, and a control unit for turning on the first power transistor and the second power transistor. An aspect ratio of the first power transistor is smaller than an aspect ratio of the second power transistor. The control unit turns on the second power transistor in a predetermined period of time after the first power transistor is turned on.

5 Claims, 10 Drawing Sheets

VOLTAGE REGULATOR HAVING SOFT STARTING FUNCTION AND METHOD OF CONTROLLING THE SAME

CROSS-REFERENCE TO RELATED APPLICATIONS

This application claims priority to and the benefit of Korean Patent Application No. 10-2011-0096502, filed on Sep. 23, 2011, in the Korean Intellectual Property Office, and Chinese Patent Application No. 201010526419.2, filed on Oct. 25, 2010, in the State Intellectual Property Office, the entire contents of which are incorporated by reference herein.

BACKGROUND

The present disclosure relates to a voltage regulator, and more particularly, to a voltage regulator including a soft start circuit.

Most electronic devices such as computer, televisions, portable devices, and the like, include voltage regulators to supply a stable direct current. In particular, as semiconductor devices become smaller, low voltage regulators that supply low voltages from several volts to several tens of volts have been used. Low dropout (LDO) voltage regulators have been used to supply regulated voltages from power sources. Such LDO voltage regulators can operate with a very small input-output differential voltage and can provide a lower minimum operating voltage, higher efficiency operation and lower heat dissipation. However, a need exists for voltage regulators that can prevent damage to a power source resulting from inrush current.

SUMMARY

In accordance with an exemplary embodiment of the inventive concept a voltage regulator configured to perform a soft starting operation without an additional current consumption is provided.

Exemplary embodiment of the inventive concept also provide voltage regulator circuits configured to restrict an excessive flow of an inrush current.

According to an exemplary embodiment, a voltage regulator apparatus includes a first power transistor and a second power transistor connected in parallel to each other between a first power source and an output terminal, and a control unit configured to turn on the first power transistor and the second power transistor. An aspect ratio of the first power transistor is smaller than an aspect ratio of the second power transistor. The control unit is configured to turn on the second power transistor in a predetermined period of time after the first power transistor is turned on.

The aspect ratio of the first power transistor may be determined such that a maximum current flowing through the first power transistor is smaller than a rated current of the first power source.

The aspect ratio of the first power transistor and an aspect ratio of the second power transistor may be determined such that a maximum value of a current sum flowing through the first power transistor and the second power transistor is equal to the rated current of the first power source.

The voltage regulator apparatus may further include an amplifier connected to the first power transistor and to the second power transistor and configured to control the first power transistor and the second power transistor based upon a comparison between a feedback voltage corresponding to a voltage of an output terminal and a reference voltage. The first power transistor and the second power transistor may be controlled by the amplifier and output voltages of predetermined levels at the output terminal.

The predetermined period of time may be longer than or equal to a time when a voltage of the output terminal of the voltage regulator apparatus is the same as a predetermined output voltage.

The enable signal may be supplied from the first power source.

The voltage regulator apparatus may further include a first switching unit configured to turn on the first power transistor in response to the enable signal and a second switching unit configured to turn off the second power transistor simultaneously with the first switching unit in response to a delayed enable signal.

According to an exemplary embodiment, a voltage regulator circuit includes a first power transistor comprising a first electrode connected to a first power source and a second electrode connected to an output terminal, a second power transistor comprising a third electrode connected to the first power source and a fourth electrode connected to the output terminal, and a controller. An aspect ratio of the first power transistor is smaller than an aspect ratio of the second power transistor. The controller is connected to a control electrode of the first power transistor and a control electrode of the second power transistor. The controller is configured to sequentially turn on the first power transistor and the second power transistor in response to a received enable signal. If the enable signal is received, the controller is configured to turn on the first power transistor such that the first power source supplies power to the output terminal through the first power transistor. After a predetermined period of time after the first power transistor is turned on, the controller is configured to turn on the second power transistor such that the first power source supplies the power to the output terminal through the first power transistor and the second power transistor.

The aspect ratio of the first power transistor may be determined such that a maximum current flowing through the first power transistor is smaller than a rated current of the first power source.

The aspect ratio of the first power transistor and an aspect ratio of the second power transistor may be determined such that a maximum value of a current sum flowing through the first power transistor and the second power transistor is equal to the rated current of the first power source.

The voltage regulator circuit may further include an error amplifier comprising a non-inversion input terminal, an inversion input terminal, and a signal output terminal, a feedback resistance network connected to the output terminal and the second power source, a reference voltage source configured to supply a reference voltage to the inversion input terminal of the error amplifier, a first driving buffer connected between the signal output terminal of the error amplifier and the control electrode of the first power transistor, and a second driving buffer connected between the signal output terminal of the error amplifier and the control electrode of the second power transistor. The feedback resistance network is configured to generate a feedback signal corresponding to an output voltage of the voltage regulator circuit, and to supply the feedback signal to the non-inversion input terminal of the error amplifier. The error amplifier is configured to control the first power transistor and the second power transistor based upon a comparison between a voltage level of the feedback signal and a level of the reference voltage such that the voltage regulator circuit outputs a predetermined voltage determined by the reference voltage and the feedback resistance network.

The controller may include a start trigger. If the controller receives the enable signal, the controller may be configured to supply the enable signal to the error amplifier, to the reference voltage source, and to the first driving buffer to operate the error amplifier, the reference voltage source, and the first driving buffer. If the start trigger receives the enable signal, the start trigger may delay the enable signal during the predetermined period of time and may supply the delayed enable signal to the second driving buffer to operate the second driving buffer.

The voltage regulator circuit may further include a first switching unit comprising a control electrode connected to the controller, a first electrode connected to the first power source, and a second electrode connected to the control electrode of the first power transistor; and a second switching unit comprising the control electrode connected to the controller, the first electrode connected to the first power source, and a second electrode connected to the control electrode of the second power transistor. The first switching unit may be configured to turn on in response to a signal supplied from the controller and turns off the first power transistor. The second switching unit may be configured to turn on in response to a signal supplied from the controller and to turn off the second power transistor simultaneously with the first power transistor.

According to an exemplary embodiment a voltage regulator includes a control circuit configured to provide an enable signal and a delayed enable signal, and a switching circuit coupled to the control circuit and configured to generate a first driving current from a power source through a first power transistor to an output terminal in response to the enable signal and to generate a second driving current from the power source through a second power transistor to the output terminal in response to the delayed enable signal.

The control circuit may be configured to turn on the second power transistor after a predetermined time from when the first power transistor is turned on such that a desired intensity of power from the power source is supplied to an external circuit connected to the output terminal through both the first power transistor and the second power transistor.

The first power transistor and the second power transistor may p-type metal oxide semiconductor transistors and may be connected in parallel to each other between the power source and the output terminal.

An aspect ratio of the first power transistor may be configured to limit an intensity of the first driving current such that the power source is not damaged by an inrush current.

The second power transistor may have an aspect ratio higher than the aspect ratio of the first power transistor.

BRIEF DESCRIPTION OF THE DRAWINGS

Exemplary embodiments of the inventive concept will be more clearly understood from the following detailed description taken in conjunction with the accompanying drawings in which.

DETAILED DESCRIPTION OF THE EXEMPLARY EMBODIMENTS

Figure 1:
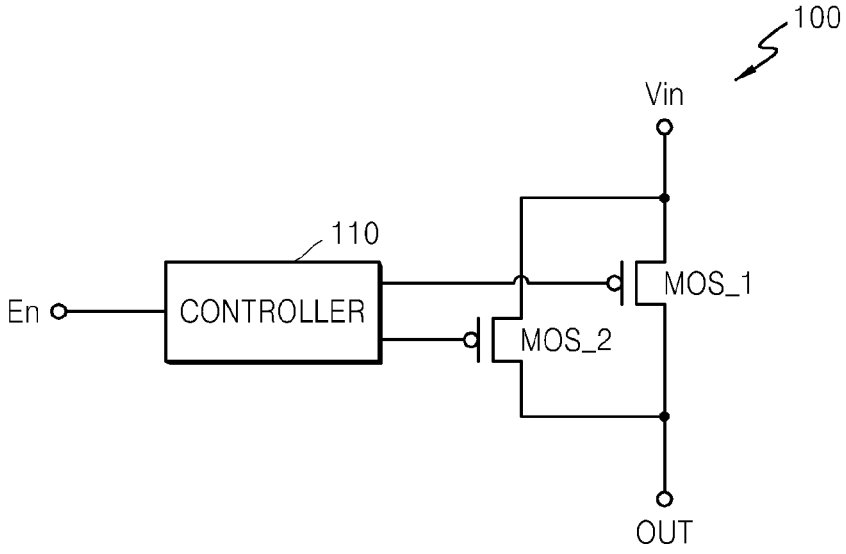
FIG. 1 is a block diagram of a voltage regulator according to an exemplary embodiment of the inventive concept.

The inventive concept will now be described more fully with reference to the accompanying drawings, in which exemplary embodiments of the inventive concept are shown. Throughout the drawings like reference numerals denote like elements.

Furthermore, all examples and conditional language recited herein are to be construed as being without limitation to such specifically recited examples and conditions. Throughout the specification, a singular form may include plural forms, unless there is a particular description contrary thereto. Also, terms such as "comprise" or "comprising" are used to specify existence of a recited form, a number, a process, an operations, a component, and/or groups thereof, not excluding the existence of one or more other recited forms, one or more other numbers, one or more other processes, one or more other operations, one or more other components and/or groups thereof.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could not be termed a second element, component, region, layer or section without departing from the teachings of the inventive concept.

An inrush current used herein means a current flowing through a power source supplying power to a voltage regulator when the voltage regulator starts operating. A rated current of the power source used herein means a maximum current used to operate the power source without damaging the power source. The power source may be damaged when a current flows exceeding the rated current.

FIG. 1 is a block diagram of a voltage regulator 100 according to an exemplary embodiment of the inventive concept.

Referring to FIG. 1, the voltage regulator 100 includes a first power transistor MOS_1, a second power transistor MOS_2, and a controller 110. The first power transistor MOS_1 and the second power transistor MOS_2 are P type MOS transistors. However, exemplary embodiments of the inventive concept are not limited thereto, and various types of transistors may be used as power transistors according to circuit design needs. The first power transistor MOS_1 and the second power transistor MOS_2 are connected in parallel to each other between a first power source Vin and an output terminal OUT.

The controller 110 may receive an enable signal. The controller 110 may be connected to gate electrodes of the first power transistor MOS_1 and the second power transistor MOS_2.

The operation of the voltage regulator 100 will now be described below. The enable signal En may be supplied to the controller 110 through an enable signal input terminal En of the voltage regulator 100. Thus, the controller 110 may sequentially turn on the first power transistor MOS_1 and the second power transistor MOS_2 in response to the received enable signal.

More specifically, if the enable signal is received, the controller 110 may turn on the first power transistor MOS_1. Accordingly, power supplied from the first power source Vin is supplied to the output terminal OUT through the first power transistor MOS_1. Thus, the power supplied from the first power source Vin may be supplied to an external circuit connected to the output terminal OUT. At the instant when the first power transistor MOS_1 is turned on, an inrush current is generated due to a capacitor component of the external circuit (for example, load) connected to the output terminal OUT. An intensity of the inrush current depends on an aspect ratio (W/L) of the first power transistor MOS_1. The aspect ratio (W/L) of the first power transistor MOS_1 is determined to limit the intensity of the inrush current in such a way that the first power source Vin is not damaged. The controller 110 may turn on the first power transistor MOS_1, and, after a predetermined period of time, turn on the second power transistor MOS_2. Thus, the power supplied from the first power source Vin may be supplied to the output terminal OUT through the first power transistor MOS_1 and the second power transistor MOS_2. As a result, a sufficient intensity of power may be supplied to the external circuit connected to the output terminal OUT.

According to an exemplary embodiment, the controller 110 may turn on the second power transistor MOS_2 if a voltage level of the output terminal OUT reaches a predetermined output voltage level of the voltage regulator 100. Thus, the inrush current generated when the first power transistor MOS_1 having a low aspect ratio is first turned on is limited to a predetermined level by the aspect ratio of the first power transistor MOS_1, thereby preventing the first power source Vin from being damaged. When the power transistor MOS_2 of a high aspect ratio is turned on after the first power transistor MOS_1 is first turned on, a sufficient intensity of current may be supplied to the external circuit connected to the output terminal OUT. In this case, a current necessary for driving the external circuit may be supplied through the first power transistor MOS_1 and the second power transistor MOS_2.

According to an exemplary embodiment, the aspect ratio of the first power transistor MOS_1 may be determined according to a rated current of the first power source Vin. That is, the aspect ratio of the first power transistor MOS_1 may be determined so that the inrush current generated when the first power transistor MOS_1 is turned on is smaller than the rated current of the first power source Vin. An aspect ratio of the second power transistor MOS_2 may be determined according to the rated current of the first power source Vin and the aspect ratio of the first power transistor MOS_1. That is, the aspect ratio of the second power transistor MOS_2 may be determined in such a way that the second power transistor MOS_2 may easily pass through a current supplied from the first power source Vin.

Figure 2:
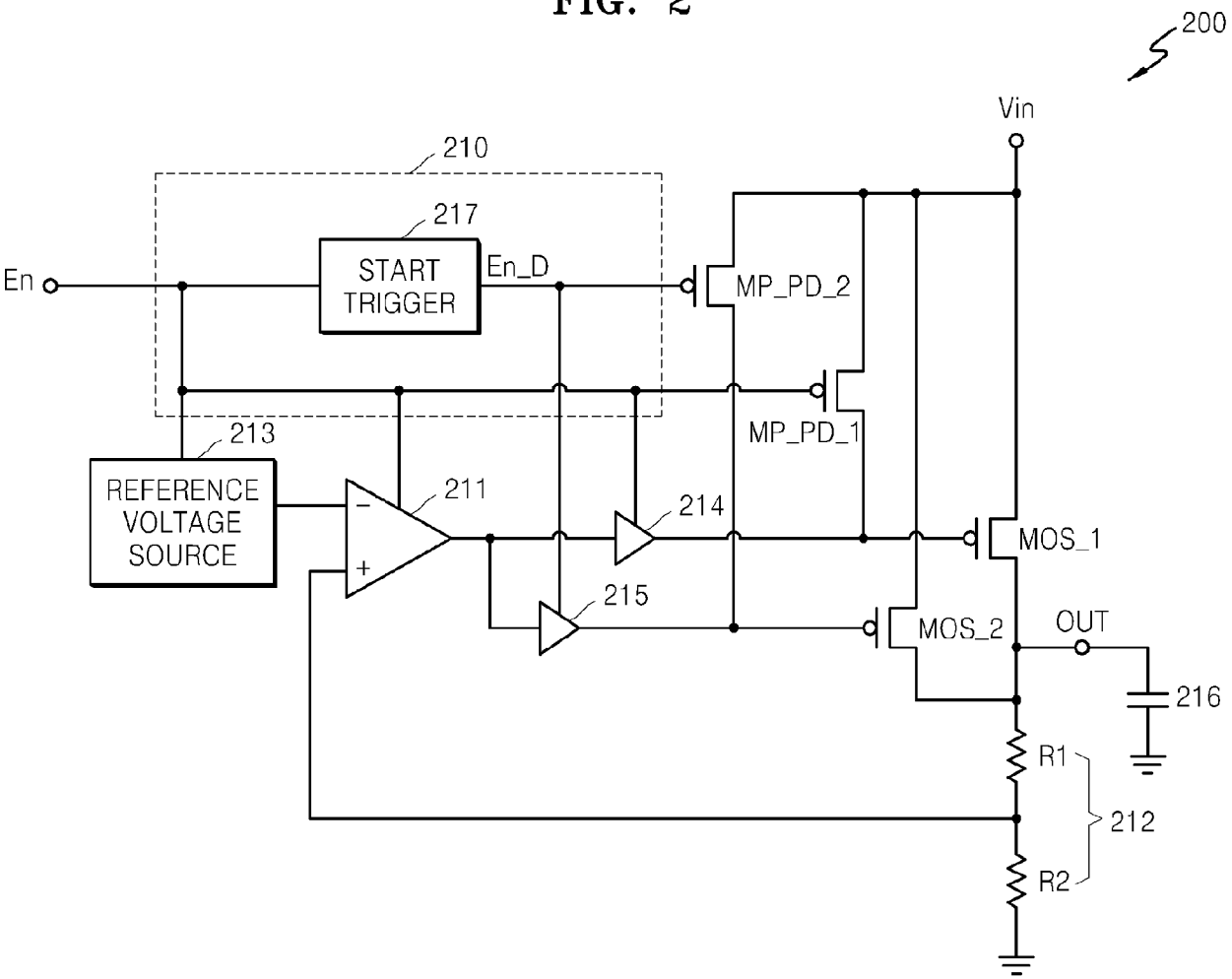
FIG. 2 is a circuit diagram of a voltage regulator according to an exemplary embodiment of the inventive concept.

FIG. 2 is a circuit diagram of a voltage regulator 200 according to an exemplary embodiment of the inventive concept.

Referring to FIG. 2, the voltage regulator 200 may include the first power transistor MOS_1, the second power transistor MOS_2, a first switching unit (a transistor) MP_PD_1, a second switching unit (a transistor) MP_PD_2, a controller 210, an error amplifier 211, a feedback resistance network 212, a reference voltage source 213, and driving buffers 214, 215.

As shown in FIG. 2, the first switching unit MP_PD_1 may be a p type double diffused metal oxide semiconductor (PDMOS) transistor. The first switching unit MP_PD_1 may include a source electrode connected to the first power source Vin and a drain electrode connected to the first power transistor MOS_1. The second switching unit MP_PD_2 may be a p type PDMOS transistor. The second switching unit MP_PD_2 may include the source electrode connected to the first power source Vin and a drain electrode connected to the second power transistor MOS_2. Although switching units are shown as the p type PDMOS transistors MP_PD_1 and MP_PD_2 in FIG. 2, exemplary embodiments of the inventive concept are not limited thereto. One of ordinary skill in the art may use various types of transistors and small size PMOS transistors as switching units.

The first power transistor MOS_1 and the second power transistor MOS_2 may be connected in parallel to each other between the first power source Vin and the output terminal OUT. For example, the first power transistor MOS_1 and the second power transistor MOS_2 may each include a first electrode connected to the first power source Vin and a second electrode connected to the output terminal OUT. The first switching unit MP_PD_1 may include the first electrode connected to the first power source Vin and a second electrode connected to a control electrode of the first power transistor MOS_1. The first switching unit MP_PD_1 may include a control electrode connected to the controller 210, and be turned on in response to a signal (for example, a low level signal) supplied from the controller 210 in order to turn off the first power transistor MOS_1. The second switching unit MP_PD_2 may include the first electrode connected to the first power source Vin and a second electrode connected to a control electrode of the second power transistor MOS_2. The second switching unit MP_PD_2 may include the control electrode connected to the controller 210. The second switching unit MP_PD_2 may be turned on in response to the signal (for example, the low level signal) supplied from the controller 210 in order to turn off the second power transistor MOS_2.

The controller 210 may include a start trigger 217. An enable signal may be supplied to the controller 217 through the enable signal input terminal EN of the voltage regulator 200. The controller 210 may receive the enable signal. The start trigger 217 may delay the enable signal for a predetermined period of time and generate the delayed enable signal The start trigger 217 may supply the delayed enable signal to the second switching unit MP_PD_2 to allow the second switching unit MP_PD_2 to be turned on. In this case, the predetermined period of time may be longer than or equal to time taken by the voltage level of the output terminal OUT to reach the predetermined output voltage level of the voltage regulator 100.

The error amplifier 211 may include a non-inversion input terminal +, an inversion input terminal −, and a signal output terminal.

The feedback output resistance network 212 may be connected between the output terminal OUT and a second power source (i.e. a ground). The feedback resistance network 212 may include resistors R1, R2 that are connected in series to each other, and supply a feedback signal corresponding to an output voltage of the output terminal OUT to the non-inversion input terminal + of the error amplifier 211. The feedback signal is a voltage signal that distributes output voltages of the output terminal OUT to the feedback resistance network 212. The feedback signal is proportional to an output voltage.

The reference voltage source 213 may generate a reference voltage, and supply the reference voltage to the inversion input terminal—of the error amplifier 211. The reference voltage determines an output voltage level of the output terminal OUT. The output voltage level may be determined as (R1+R2)/R1 times the reference voltage. The first driver buffer 214 may be connected between the signal output terminal of the error amplifier 211 and the control electrode of the first power transistor MOS_1. The second driving buffer 215 may be connected between the signal output terminal of the error amplifier 211 and the control electrode of the second power transistor MOS_2. In FIG. 2, the capacitor 216 presents a capacitor component of an external circuit.

According to an exemplary embodiment, the controller 210 may supply the enable signal to the error amplifier 211, to the reference voltage source 213, and to the first driving buffer 214. The error amplifier 211, the reference voltage source 213, and the first driving buffer 214 operate in response to the enable signal. The controller 210 may delay the enable signal during a predetermined time through the start trigger 217. The controller 210 may supply the delayed enable signal to the second driving buffer 215 to allow the second driving buffer 215 to operate. That is, the voltage regulator 200 may start operating in response to the enable signal.

According to an exemplary embodiment, the reference voltage source 213 may be a band gap reference voltage source, and the error amplifier 211 may be a 2 step differential operation amplifier. The band gap reference voltage source means a reference voltage source that predictably varies according to a temperature. Thus, according to an exemplary embodiment; if the reference voltage source 213 is the band gap reference voltage source, a reference voltage may be predictable according to temperature.

As described above, the error amplifier 211 may compare the feedback signal supplied by the feedback resistance network 212 and the reference voltage generated by the reference voltage source 213. If a voltage level of the feedback signal exceeds a level of the reference voltage, the error amplifier 211 may output an output signal through the signal output terminal. Thus, the error amplifier 211 may supply the output signal to the control terminal of the first power transistor MOS_1 through the first driving buffer 214. The first power transistor MOS_1 reduces an amount of a current flowing through the first power transistor MOS_1, which reduces the voltage level of the feedback signal. On the other hand, if the voltage level of the feedback signal is lower than the level of the reference voltage, the first power transistor MOS_1 increases the amount of the current flowing through the first power transistor MOS_1, which increases the voltage level of the feedback signal. However, the maximum amount of the current flowing through the first power transistor MOS_1 is determined according to an aspect ratio of the first power transistor MOS_1. As a result, when the voltage regulator 200 starts operating, a large amount of a current (such as a theoretical infinite current if the external circuit has no resistance component) must flow so as to charge the capacitor component of the external circuit, i.e. the capacitor 216. However, since the current is restricted by the aspect ratio of the first power transistor MOS_1, a large amount of an inrush current by which a power source may be damaged is not generated.

Figure 3:
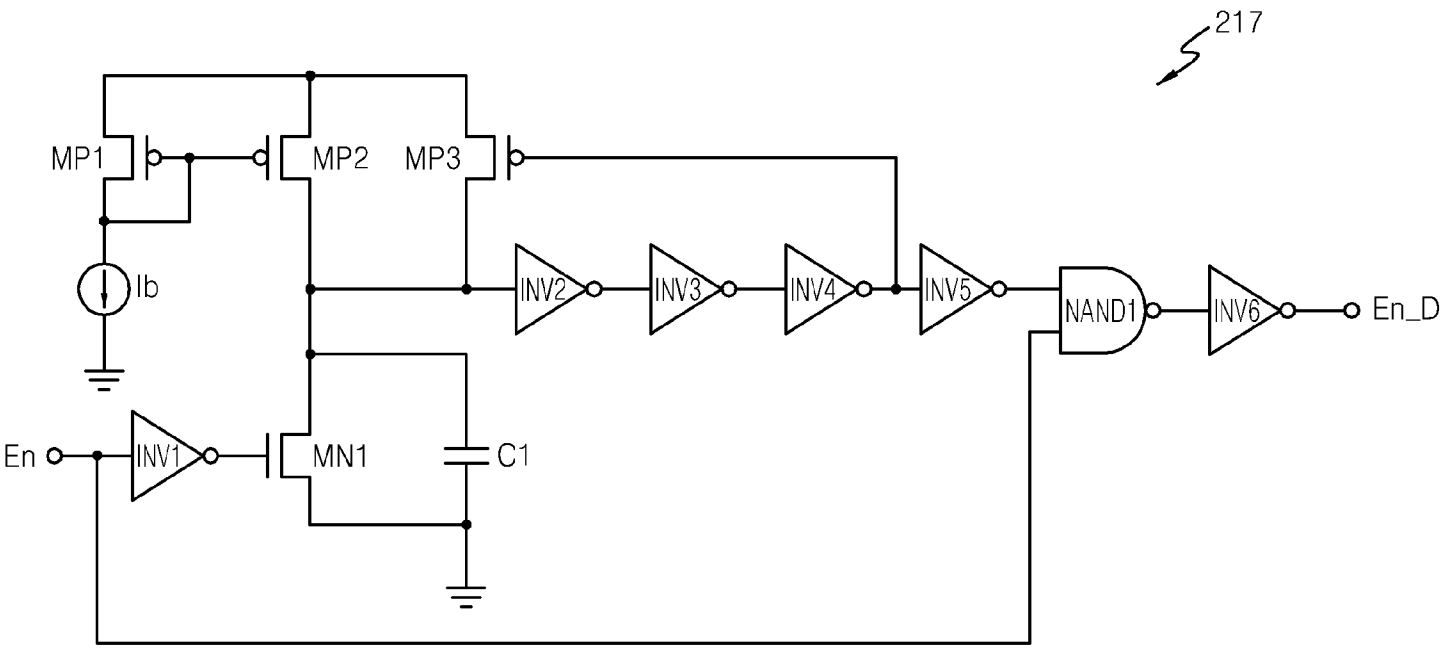
FIG. 3 is a circuit diagram of a start trigger included in a voltage regulator according to an exemplary embodiment of the inventive concept.

FIG. 3 is a circuit diagram of a start trigger included the voltage regulator 200 according to an exemplary embodiment of the inventive concept.

Referring to FIG. 3, the start trigger 217 may include transistors MP1, MP2, MP3, MN1, a capacitor C1, a bias current source 1*b*, inverters IV1-INV6, and a NAND gate NAND1. The transistors MP1, MP2 may be included as a PMOS current mirror. The capacitor C1 may be a capacitor connected to a source electrode and a drain electrode of the transistor MN1 or a parasitic capacitor of the transistor MN1. When an enable signal is received from the enable signal input terminal En, the start trigger 217 may delay the enable signal for a predetermined time, and output the delayed enable signal through a delay output terminal En_D. The time taken to delay the enable signal may be determined according to the bias current source 1*b*, aspect ratios of the transistors MP1, MP2, a capacitance of the capacitor C1, and delay time of the inverters INV2, INV3, INV4. Thus, the time taken to delay the enable signal may be determined by controlling the aspect ratios of the transistors MP1, MP2 and the capacitance of the capacitor C1. That is, the start trigger 217 generates the delayed enable signal by delaying the enable signal for a time taken to charge the capacitor C1 to a high level by using a drain current of the transistor MP2.

In FIG. 3, when the enable signal transistions from a low level to a high level, the enable signal is delayed for approximately the time taken to charge the capacitor C1 to the high level by using the drain current of the transistor MP2, and the delayed enable signal is transited to the high level. However, when the enable signal transitions from the high level to the low level, the enable signal is delayed and transitions to the low level almost at the same time according to a low level enable signal input into the NAND gate NAND1.

Figure 4:
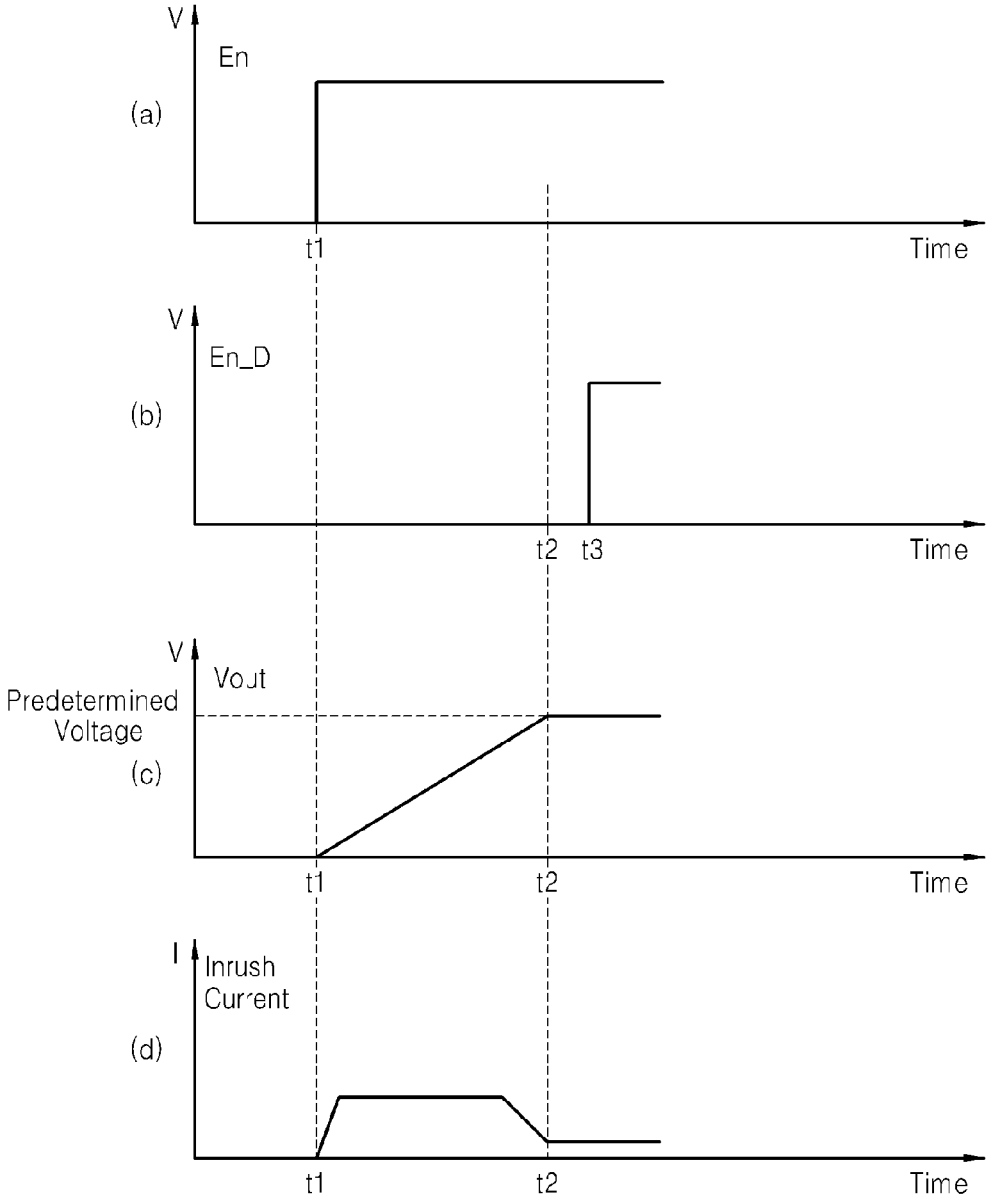
FIG. 4 depicts (a), (b), (c) and (d) graphs of a waveform of a voltage regulator according to an exemplary embodiment of the inventive concept.

In FIG. 4 graphs (a), (b), (c) and (d) depict waveforms of the voltage regulator 200 according to an exemplary embodiment of the inventive concept.

The voltage regulator 200 receives an enable signal at a time t1 through the enable signal input terminal En. Referring to FIG. 4 graph (a), a high level signal may be used as an enable signal. In this case, the reference voltage source 213, the error amplifier 211, and the first driving buffer 214 start operating in response to the received enable signal of a high level. Meanwhile, the first switching unit MP_PD_1 is turned on so that the first power transistor MOS_1 is turned on. Referring to FIG. 4 graph (c), the first power source Vin supplies power to the output terminal OUT through the first power transistor MOS_1, and thus a voltage level gradually increases in the output terminal OUT connected to an external circuit. Referring to FIG. 4 graph (d), an inrush current is generated when the first power transistor MOS_1 is turned on. However, the inrush current is restricted by an aspect ratio of the first power transistor MOS_1.

Referring to FIG. 4 graph (b), the start trigger 217 may output a delayed enable signal at a time t3 through the delay output terminal En_D. That is, the start trigger 217 may delay the enable signal during a predetermined time t3-t1. The predetermined time t3-t1 may be equal to or longer than a time t2-t1 when a voltage level of the output terminal OUT is materially the same as a predetermined output voltage level of the voltage regulator 200 from the time t1 when the first power transistor MOS_1 is turned on. Thus, if the second power transistor MOS_2 is turned on, a sufficient amount of a current, i.e. a greater amount of a current than that of a current restricted by the aspect ratio of the first power transistor MOS_1, may be applied to the external circuit.

If a supply of the enable signal is stopped (i.e., if a signal supplied from the enable signal input terminal En is switched from a high level to a low level), the start trigger 217 may not delay a low level signal. A delayed enable signal is switched to a low level at the same time when the enable signal is switched to a low level. As a result, the controller 210 simultaneously supplies the low level signal to the error amplifier 211, to the reference voltage source 213, and to the driving buffers 214, 215, and the first and second switching units MP_PD_1, MP_PD_2 are turned on, and thus the first power transistor MOS_1 and the second power transistor MOS_2 included in the voltage regulator 200 may be simultaneously turned off.

In the exemplary embodiment above, the enable signal En may be supplied from the outside of an enable signal terminal However, the exemplary embodiment of the inventive concept is not limited thereto. According to an exemplary embodiment, the first power source Vin may be connected to the enable signal input terminal En of the voltage regulator 100, and an output thereof may be used as the enable signal En. Thus, it is unnecessary to supply the enable signal En from the outside.

In the exemplary embodiments above, the first power source Vin may supply a positive power level, a second power source is a ground. However, exemplary embodiments of the inventive concept are not limited thereto, and the first power source Vin may be a ground, and the second power source may supply a negative voltage level.

As described above, according to an exemplary embodiment, the voltage regulator 200 may turn on the first power transistor MOS_1 having a relatively low aspect ratio in response to a received enable signal, supply power from the first power source Vin to the output terminal OUT through the first power transistor MOS_1, and generate a relatively small amount of an inrush current. If a voltage level at the output terminal OUT is equal to a predetermined output voltage level of the voltage regulator 200, the second power transistor MOS_2 having a relatively high aspect ratio may be turned on. Thus, the second power transistor MOS_2 may operate, and a sufficient amount of a current may be supplied to the external circuit. The voltage level at the output terminal OUT connected to the external circuit gradually increases according to a feedback circuit and is stabilized to a predetermined value. Thus, the voltage regulator 200 may restrict the intensity of the inrush current.

Figure 5:
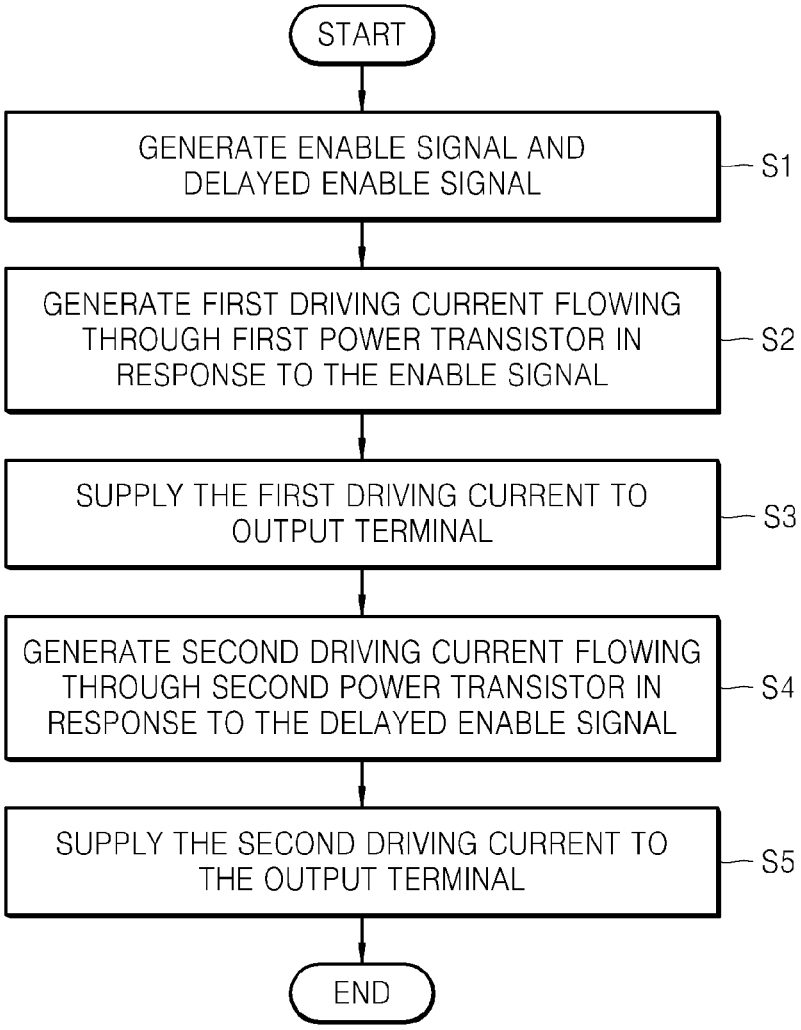
FIG. 5 is a flowchart of a method of controlling a voltage regulator according to an exemplary embodiment of the inventive concept.

FIG. 5 is a flowchart of a method of controlling a voltage regulator according to an exemplary embodiment of the inventive concept.

Referring to FIG. 5, the method of controlling the voltage regulator is as follows.

1) A delayed enable signal is generated later than an enable signal (operation S1).

2) A first power transistor is turned on in response to the enable signal, and thus an inrush current is restricted (operation S2).

3) A second power transistor is turned on in response to the delayed enabled signal, and thus a sufficient amount of a current is supplied (operation S3).

Operations S1 through S3 make it possible to control the voltage regulator so as to prevent an excessive amount of the inrush current from flowing through the voltage regulator.

Figure 6:
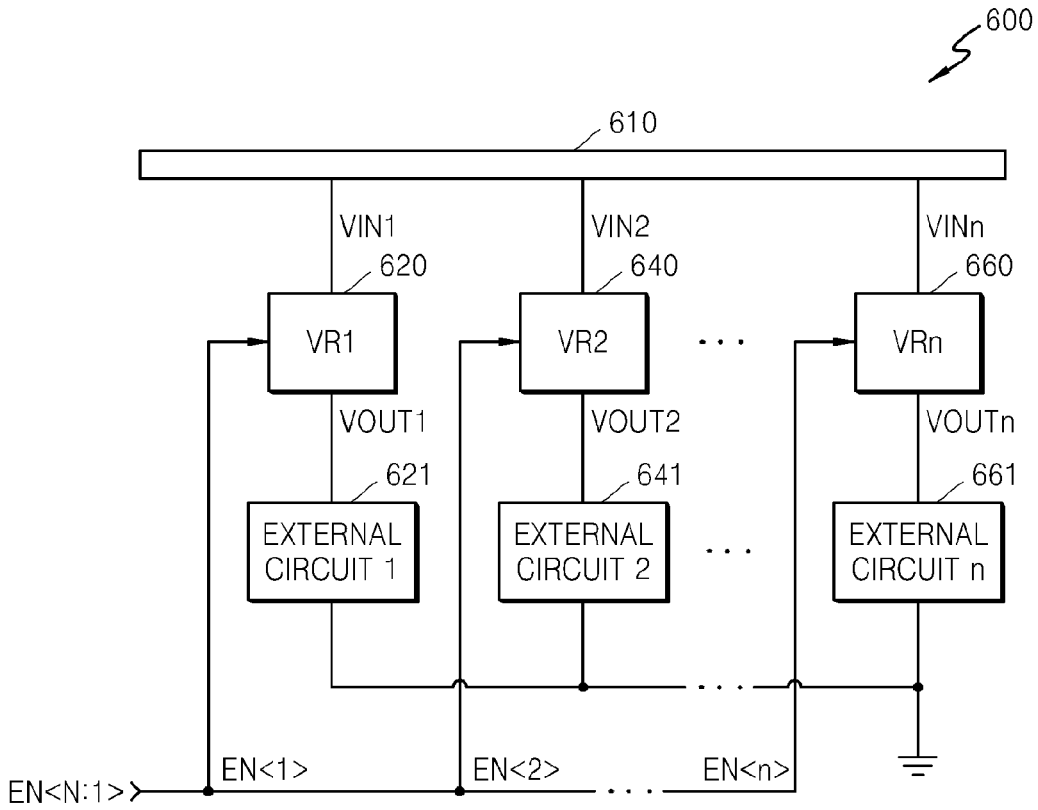
FIG. 6 illustrates a voltage regulator system including a plurality of voltage regulators according to an exemplary embodiment of the inventive concept.

FIG. 6 illustrates a voltage regulator system 600 including a plurality of voltage regulators 620, 640, 660 according to an exemplary embodiment of the inventive concept.

Referring to FIG. 6, the voltage regulators 620, 640, 660 are connected to a universal serial bus (USB) 610, and operate in response to an enable signal EN<N:1>. The voltage regulators 620, 640, 660 generate output voltages VOUT1, VOUT2, . . . VOUTn by varying input voltages VIN1, VIN2, . . . VINn through the USB 610. A driving current is charged to external circuits 621, 641, 661, respectively, connected to the voltage regulators 620, 640, 660.

For example, the voltage regulator 620 performs a soft starting operation in response to the enable signal EN<N:1> and generates the first output voltage VOUT1 from the input voltage VIN1 of the USB 610. A high inrush current may be generated since a capacitor component of the external circuit 621 is charged by a current supplied from the USB 610 at the time when the external circuit 621 starts operating. However, an inrush current is restricted by the voltage regulator 620, thereby protecting the USB 610.

The voltage regulator 640 performs the soft starting operation in response to an enable signal EN<2> and generates the second output voltage VOUT2 from the input voltage VIN2 of the USB 610. A high inrush current may be generated since a capacitor component of the external circuit 641 is charged by a current supplied from the USB 610 at the time when the external circuit 641 starts operating. However, the inrush current is restricted by the voltage regulator 640, thereby protecting the USB 610.

Figure 7:
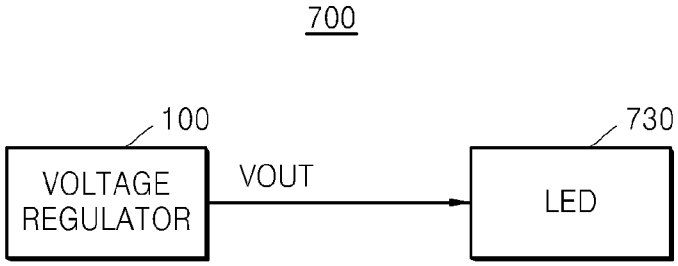
FIG. 7 is a block diagram of a display apparatus including a voltage regulator according to an exemplary embodiment of the inventive concept.

FIG. 7 is a block diagram of a display apparatus 700 including the voltage regulator 100 according to an exemplary embodiment of the inventive concept.

Referring to FIG. 7, the display apparatus 700 includes the voltage regulator 100 and a light emitting diode (LED) 730. The voltage regulator 100 supplies a stable power voltage to the LED 730.

The voltage regulator 100 may include the first power transistor MOS_1, the second power transistor MOS_2, and the controller 110 as shown in FIG. 1.

The controller 110 may turn on the second power transistor MOS_2 after turning on the first power transistor MOS_1. Thus, the first power source Vin may supply power to the output terminal OUT through the first power transistor MOS_1 and the second power transistor MOS_2 over a time interval. As a result, the power may be supplied to an external circuit connected to the output terminal OUT from the first power source Vin. A current flowing through the output terminal OUT is restricted by an aspect ratio of the first power transistor MOS_1, thereby preventing a high inrush current from being generated. Thus, the first power source Vin may not be damaged.

Figure 8:
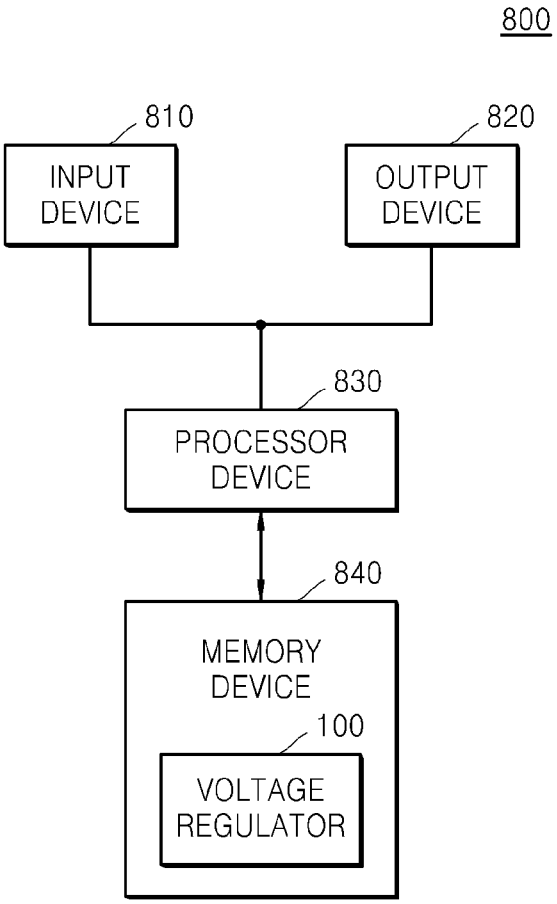
FIG. 8 is a block diagram of a memory system including a voltage regulator, according to an exemplary embodiment of the inventive concept.

FIG. 8 is a block diagram of a memory system 800 including the voltage regulator 100, according to an exemplary embodiment of the inventive concept.

Referring to FIG. 8, the memory system 800 includes an input device 810, an output device 820, a processor device 830, and a semiconductor memory device 840. The processor device 830 may control the input device 810, the output device 820, and the semiconductor device 830 by using corresponding interfaces. The processor device 830 may include at least one microprocessor, a digital signal processor, a microcontroller, and at least one of logic devices capable of performing similar functions. The input device 810 and the output device 820 may include at least one selected from the group consisting of a key pad, a keyboard, and a display device.

The semiconductor memory device 840 may include the voltage regulator 100 of FIG. 1, the voltage regulator 200 of FIG. 2, or the voltage regulator 600 of FIG. 6. The voltage regulator 100 according to the exemplary embodiments of the inventive concept may be included in the semiconductor memory device 840. The voltage regulator 100 includes a pair of a power transistor and a control unit, which prevents an excessive amount of an inrush current when a voltage is supplied to the semiconductor device 840, thereby preventing the memory system 800 from being damaged due to a malfunction of the memory system 800 and an excessive supply of a current.

Figure 9:
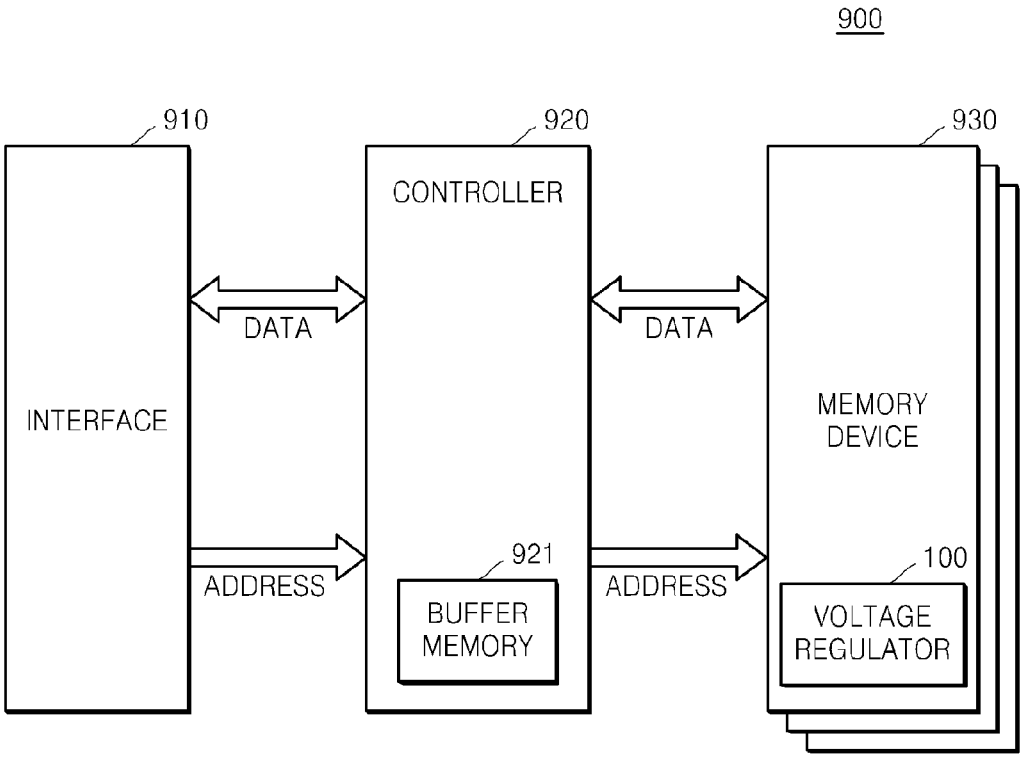
FIG. 9 is a block diagram of a memory system including a voltage regulator, according to another exemplary embodiment of the inventive concept.

FIG. 9 is a block diagram of a memory system 900 including the voltage regulator 100, according to an exemplary embodiment of the inventive concept.

Referring to FIG. 9, the memory system 900 may include an interface unit 910, a controller 920, and the semiconductor memory device 930. The interface unit 910 may interface between the memory system 900 and a host apparatus (not shown). For the interfacing with the host apparatus, the interface unit 910 may include a data exchange protocol corresponding to the host apparatus. The interface unit 910 may be configured to communicate with the host apparatus by using one of various interface protocols including a USB, a multimedia card (MMC), a peripheral component interconnect-express, a serial-attached SCSI (SAS), a serial advanced technology attachment (SATA), a parallel advanced technology attachment (PATA), a small computers system interface (SCSI), an enhanced small disk interface (ESDI), and integrated drive electronics (IDEs).

The controller 920 may receive data and an address provided from the outside via the interface unit 910. The controller 920 may access the semiconductor memory device 930 by referring to the data and the address provided from the host apparatus. The controller 920 may deliver data read from the semiconductor device 930, to the host apparatus via the interface unit 910.

The controller 920 may include a buffer memory 921. The buffer memory 921 temporarily stores write data provided from the host apparatus, or the read from the semiconductor memory device 930. When data stored in the semiconductor device 930 is cached at a read request from the host apparatus, the buffer memory 921 supports a cache function of providing the cached data directly to the host apparatus. Typically, a data transmission speed by a bus format (e.g., SATA or SAS) of the host apparatus may be significantly faster than a transmission speed of a memory channel in the memory system 900. That is, in a case where an interface speed of the host apparatus is significantly fast, performance deterioration due to a speed difference may be minimized by providing the buffer memory 921 to the memory channel in the memory system 900.

The voltage regulator 100 according to the exemplary embodiments of the inventive concept may be disposed in the semiconductor memory device 930.

The semiconductor memory device 930 may be provided as a storage medium of the memory system 900. For example, the semiconductor memory device 930 may be implemented as a resistive memory device. Alternatively, the semiconductor memory device 930 may be implemented as a NAND-type flash memory having mass storage capacity. The semiconductor memory device 930 may include a plurality of memory devices. The semiconductor memory device 930 as a storage medium may use a PRAM, a MRAM, a ReRAM, a FRAM, or a NOR flash memory, and different types of memory devices may be applied to the memory system 900.

Figure 10:
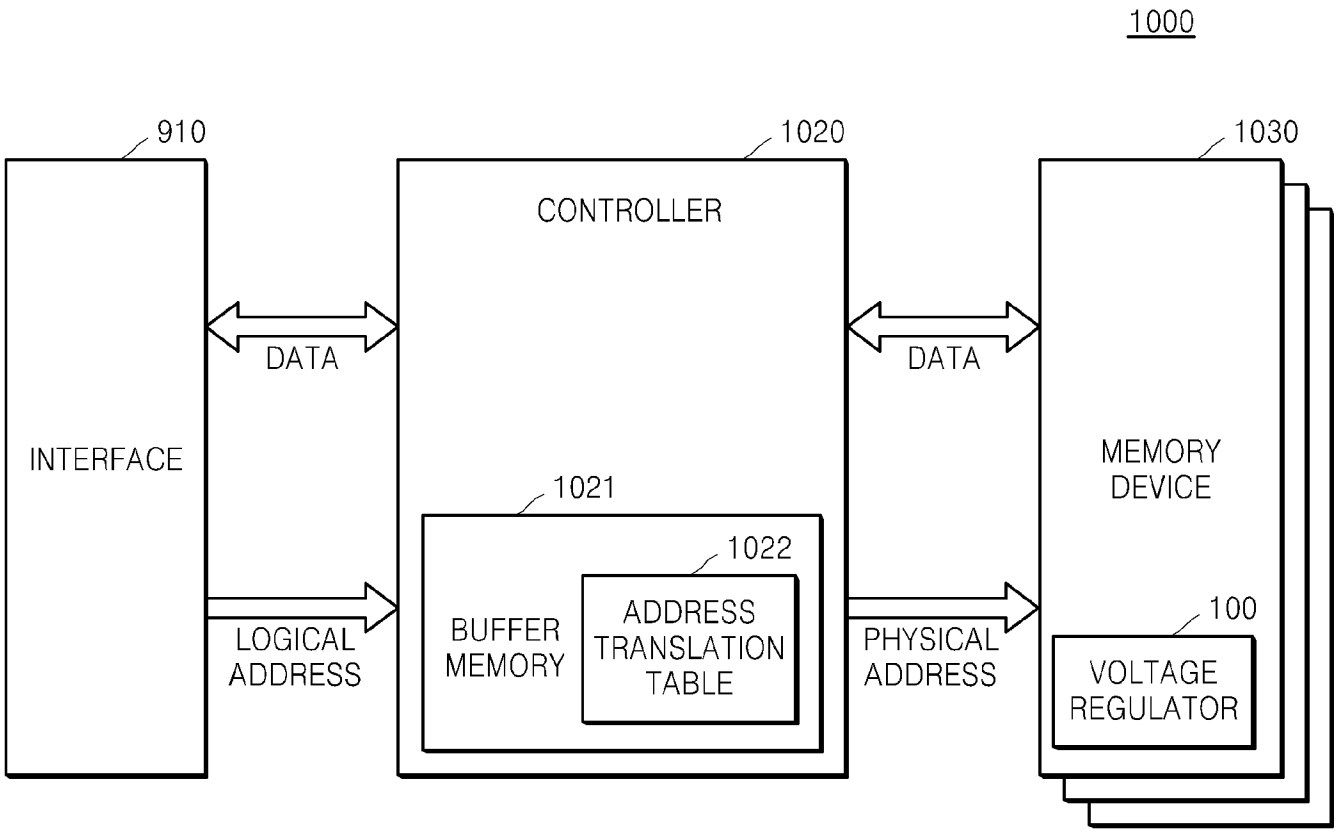
FIG. 10 is a block diagram of a memory system including a voltage regulator, according to another exemplary embodiment of the inventive concept.

FIG. 10 is a block diagram of a memory system 1000 using the voltage regulator 100, according to an exemplary embodiment of the inventive concept.

Referring to FIG. 10, the memory system 1000 includes an interface unit 1010, a controller 1020, and a semiconductor memory device 1030. The interface unit 1010 may include a data exchange protocol corresponding to a host apparatus to interface with the host apparatus (not shown) similar to the interface unit 910 of FIG. 9. The semiconductor memory device 1030 may include a semiconductor disk device (e.g., a solid-state drive (SSD)) including the voltage regulator 100. The memory system 1000 may be referred to as a flash memory system.

The controller 1020 may include a buffer memory 1021 having an address translation table 1022. The controller 1020 may refer to the address translation table 1022 and then may change a logical address provided by the interface unit 910 to a physical address. The controller 1020 may access the semiconductor memory device 1030 by referring to the translated physical address.

The memory systems 900, 1000 of FIGS. 9 and 10 may be mounted in an information processing apparatus, including a personal digital assistant (PDA), a portable computer, a web tablet, a digital camera, a portable media player (PMP), a mobile phone, a wireless phone, or a laptop computer. The memory systems 900, 1000 may include an MMC card, a secure digital (SD) card, a micro SD card, a memory stick, an identification (ID) card, a personal computer memory card international association (PCMCIA) card, a chip card, a USB card, a smart card, or a compact flash (CF) card.

Figure 11:
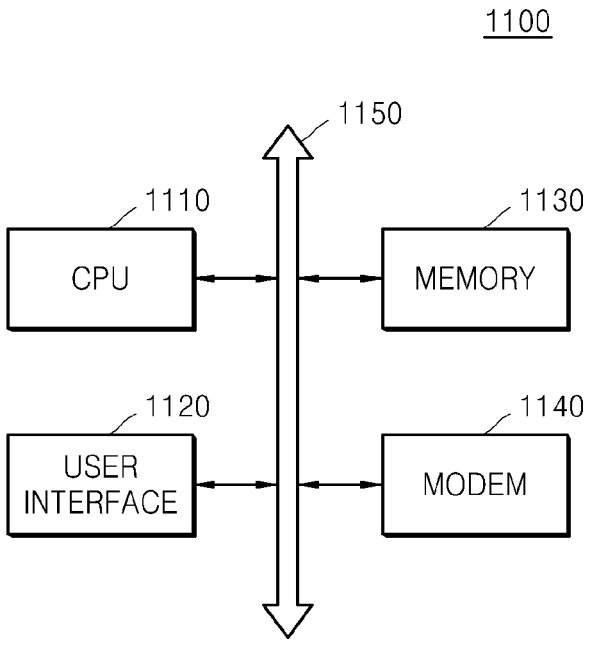
FIG. 11 illustrates a computer system including a voltage regulator, according to an exemplary embodiment of the inventive concept.

FIG. 11 illustrates a computer system 1100 including the voltage regulator 100, according to an exemplary embodiment of the inventive concept.

Referring to FIG. 11, the computer system 1100 may include a central processing unit (CPU) 1110, a user interface 1120, a memory 1130, and a modem 1140 such as a baseband chipset that are electrically connected to a system bus 1150. The user interface 1120 may be used to transmit or receive data to or from a communication network (not shown). The user interface 1120 may be wired or wireless and may include an antenna or a wire-wireless transceiver. Data provided via the user interface 1120 or the modem 1140, or processed by the CPU 1110 may be stored in the memory 1130.

The memory 1130 may include a volatile memory device such as a DRAM and/or a non-volatile memory device such as a flash memory. The memory 1130 may be formed as a DRAM, a PRAM, a MRAM, a ReRAM, a FRAM, a NOR flash memory, an NAND flash memory, or a fusion flash memory (e.g., a memory formed by combining a SRAM buffer, a NAND flash memory and a NOR interface logic) in which the voltage regulator 100 according to the exemplary embodiments is disposed.

When the computer system 1100 according to the present exemplary embodiment is a mobile device, a battery (not shown) may be additionally provided to supply an operating voltage to the computer system 1100. Although not shown, the computer system 1100 according to the present exemplary embodiment may further include an application chipset, a camera image processor (CIP), an input/output device, and the like.

When the computer system 1100 according to the present exemplary embodiment is a device performing wireless communication, the computer system 1100 may be used in communication systems, including code division multiple access (CDMA), global system for mobile communication (GSM), north American multiple access (NADC), CDMA2000, or the like.

While the inventive concept has been particularly shown and described with reference to exemplary embodiments thereof, it will be understood that various changes in form and details may be made therein without departing from the spirit and scope of the following claims.

What is claimed is:

1. A voltage regulator circuit comprising:

a first power transistor comprising a first electrode connected to a first power source and a second electrode connected to an output terminal;

a second power transistor comprising a third electrode connected to the first power source and a fourth electrode connected to the output terminal; and a controller, wherein an aspect ratio of the first power transistor is smaller than an aspect ratio of the second power transistor, wherein the controller is connected to a control electrode of the first power transistor and a control electrode of the second power transistor, wherein the controller is configured to sequentially turn on the first power transistor and the second power transistor in response to a received enable signal, wherein, if the enable signal is received, the controller is configured to turn on the first power transistor such that the first power source supplies power to the output terminal through the first power transistor, wherein, after a predetermined period of time passes after the first power transistor is turned on, the controller is configured to turn on the second power transistor such that the first power source supplies the power to the output terminal through the first power transistor and the second power transistor;

an error amplifier comprising a non-inversion input terminal, an inversion input terminal, and a signal output terminal;

a feedback resistance network connected to the output terminal and a second power source;

a reference voltage source configured to supply a reference voltage to the inversion input terminal of the error amplifier;

a first driving buffer connected between the signal output terminal of the error amplifier and the control electrode of the first power transistor; and a second driving buffer connected between the signal output terminal of the error amplifier and the control electrode of the second power transistor, wherein the feedback resistance network is configured to generate a feedback signal corresponding to an output voltage of the voltage regulator circuit, and to supply the feedback signal to the non-inversion input terminal of the error amplifier, wherein the error amplifier is configured to control the first power transistor and the second power transistor based upon a comparison between a voltage level of the feedback signal and a level of the reference voltage such that the voltage regulator circuit outputs a predetermined voltage determined by the reference voltage and the feedback resistance network;

wherein the controller comprises a start trigger, wherein, if the controller receives the enable signal, the controller is configured to supply the enable signal to the error amplifier, to the reference voltage source, and to the first driving buffer to operate the error amplifier, the reference voltage source, and the first driving buffer, and wherein, if the start trigger receives the enable signal, the start trigger delays the enable signal during the predetermined period of time and supplies the delayed enable signal to the second driving buffer to operate the second driving buffer.

2. The voltage regulator circuit of claim 1, wherein the aspect ratio of the first power transistor is determined such that a maximum current flowing through the first power transistor is smaller than a rated current of the first power source.

3. The voltage regulator circuit of claim 2, wherein the aspect ratio of the first power transistor and an aspect ratio of the second power transistor are determined such that a maximum value of a current sum flowing through the first power transistor and the second power transistor is equal to the rated current of the first power source.

4. The voltage regulator circuit of claim 1, wherein the predetermined period of time is longer than or equal to a time when a voltage of the output terminal of the voltage regulator circuit is the same as a predetermined output voltage.

5. The voltage regulator circuit of claim 1, further comprising:

a first switching unit comprising a control electrode connected to the controller, a first electrode connected to the first power source, and a second electrode connected to the control electrode of the first power transistor; and a second switching unit comprising the control electrode connected to the controller, the first electrode connected to the first power source, and a second electrode connected to the control electrode of the second power transistor, wherein the first switching unit is configured to turn on in response to a signal supplied from the controller and turns off the first power transistor, and wherein the second switching unit is configured to turn on in response to a signal supplied from the controller and to turn off the second power transistor simultaneously with the first power transistor.

* * * * *